US009719734B2

(12) United States Patent
Takahashi et al.

(10) Patent No.: US 9,719,734 B2
(45) Date of Patent: Aug. 1, 2017

(54) HEAT EXCHANGER MOUNTING STRUCTURE

(71) Applicant: DENSO CORPORATION, Kariya, Aichi-pref. (JP)

(72) Inventors: Kentaro Takahashi, Kariya (JP); Satoshi Sumiya, Takahama (JP); Shinichi Oda, Okazaki (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 264 days.

(21) Appl. No.: 14/368,884

(22) PCT Filed: Dec. 20, 2012

(86) PCT No.: PCT/JP2012/008150
§ 371 (c)(1),
(2) Date: Jun. 26, 2014

(87) PCT Pub. No.: WO2013/099166
PCT Pub. Date: Jul. 4, 2013

(65) Prior Publication Data

US 2015/0047808 A1 Feb. 19, 2015

(30) Foreign Application Priority Data

Dec. 27, 2011 (JP) ..... 2011-286443

(51) Int. Cl.
*F28F 9/007* (2006.01)
*F28F 9/00* (2006.01)
(Continued)

(52) U.S. Cl.
CPC ..... *F28F 9/007* (2013.01); *F28D 1/0435* (2013.01); *F28F 9/002* (2013.01); *F28F 9/02* (2013.01);
(Continued)

(58) Field of Classification Search
CPC .... F28F 9/007; F28F 9/002; F28F 9/02; F28F 9/262; F28D 1/0435
(Continued)

(56) References Cited

U.S. PATENT DOCUMENTS 6,059,019 A * 5/2000 Brost ..... F01P 3/18 123/41.51
6,273,182 B1 * 8/2001 Pautler ..... F28D 1/0435 165/140
(Continued)

FOREIGN PATENT DOCUMENTS

JP 449779 U 4/1992
JP 3048561 U 5/1998
(Continued)

OTHER PUBLICATIONS

Office Action in Corresponding JP Application No. 2011-286443 mailed May 13, 2014 (Japanese with English Translation).
(Continued)

*Primary Examiner* — Jianying Atkisson
*Assistant Examiner* — Raheena R Malik
(74) *Attorney, Agent, or Firm* — Harness, Dickey & Pierce, P.L.C.

(57) ABSTRACT

A heat exchanger mounting structure is provided with a bracket, a load supporting section, a fitting member, and a contact section. The bracket is provided to one of a first heat exchanger and a second heat exchanger. The load supporting section is provided to the other heat exchanger to which the bracket is not provided, and supports a load transmitted from the one of the first heat exchanger and the second heat exchanger. The fitting member is provided to the one of the first heat exchanger and the second heat exchanger, to which the bracket is provided, and is fitted over the load supporting
(Continued)

section. The contact section is in contact with at least a part of the upper portion of the bracket.

13 Claims, 8 Drawing Sheets

(51) Int. Cl.

| | |
|---|---|
| ***F28F 9/02*** | (2006.01) |
| ***F28F 9/26*** | (2006.01) |
| ***F28D 1/04*** | (2006.01) |
| *F28D 1/053* | (2006.01) |
| *F01P 3/18* | (2006.01) |
| *F28D 21/00* | (2006.01) |

(52) U.S. Cl.
CPC ..... *F28F 9/262* (2013.01); *F01P 2003/182* (2013.01); *F01P 2070/52* (2013.01); *F28D 1/05366* (2013.01); *F28D 2021/008* (2013.01); *F28F 2275/085* (2013.01)

(58) Field of Classification Search
USPC ..... 165/67, 68
See application file for complete search history.

(56) References Cited

U.S. PATENT DOCUMENTS

| | | | | |
|---|---|---|---|---|
| 6,412,581 | B2 * | 7/2002 | Enomoto | B60K 11/04 165/69 |
| 7,044,203 | B2 * | 5/2006 | Yagi | F28F 9/002 165/122 |
| 7,287,574 | B2 * | 10/2007 | Desai | F28D 1/0435 165/140 |
| 8,011,420 | B2 * | 9/2011 | Mazzocco | F28F 9/002 165/149 |
| 9,091,468 | B2 * | 7/2015 | Colpan | F25B 39/04 |
| 2008/0156456 | A1 * | 7/2008 | Hamida | F28F 9/002 165/67 |
| 2009/0133663 | A1 * | 5/2009 | Maeda | F02M 35/06 123/198 E |
| 2009/0178781 | A1 * | 7/2009 | Park | F28D 1/0435 165/67 |
| 2010/0078149 | A1 * | 4/2010 | Yoshimitsu | B60K 11/04 165/67 |
| 2012/0118532 | A1 * | 5/2012 | Jentzsch | F28F 9/002 165/67 |
| 2012/0222837 | A1 * | 9/2012 | Lanfranco | F28F 19/002 165/67 |

FOREIGN PATENT DOCUMENTS

| | | | |
|---|---|---|---|
| JP | 2002004861 | A | 1/2002 |
| JP | 2004308447 | A | 11/2004 |
| JP | 2007078306 | A | 3/2007 |
| JP | 2010255868 | A | 11/2010 |
| WO | WO-2005073654 | A1 | 8/2005 |

OTHER PUBLICATIONS

International Search Report and Written Opinion (in Japanese with English Translation) for PCT/JP2012/008150, mailed Mar. 12, 2013; ISA/JP.

* cited by examiner

HEAT EXCHANGER MOUNTING STRUCTURE

CROSS REFERENCE TO RELATED APPLICATION APPLICATIONS

This application is a U.S. National Phase Application under 35 U.S.C. 371 of International Application No. PCT/JP2012/008150 filed on Dec. 20, 2012 and published in Japanese as WO 2013/099166 A1 on Jul. 4, 2013. This application is based on Japanese Patent Application No. 2011-286443 filed on Dec. 27, 2011. The disclosures of all of the above applications are incorporated herein by reference.

TECHNICAL FIELD

The present disclosure relates to a heat exchanger mounting structure.

BACKGROUND ART

Patent document 1 and Patent document 2 disclose a conventional heat exchanger mounting structure in which a condenser or an electric fan is fixed to a radiator without using a connector such as bolt in vehicles. In this art, the condenser is mounted to the radiator using a plastic bracket, however, a slight looseness may arise between the components. In case of such a mounting structure, when the looseness caused by wear in the component, for example by aging etc., is increased, the connector may be broken, or there is a possibility such as breakage by interference between the radiator and the condenser. Therefore, it may be necessary to increase the interval between the heat exchangers or to increase the strength or the size of the connector itself.

Moreover, in the art described in Patent document 3, an elastically-deformable stopper is provided to the bracket made of plastic as a connector, and the stopper is made to be in contact with a reinforcement component on the end surface of the radiator so as to restrict the looseness by the elastic force.

The width dimension of the radiator in the front-rear direction may be different depending on the vehicle type or the engine specification. In the case where the width dimension is different among the radiators, a common tank part is used for the radiators, and a heat exchange core part is made different. In case where the multiple kinds of radiators are used, with Patent document 3, if the width dimension of the heat exchange core part of the radiator is small in the front-rear direction, the stopper cannot appropriately be in contact with the radiator, and cannot achieve the function. Furthermore, if the condenser located on the front side deviates frontward, the stopper cannot achieve the function. Moreover, if stoppers are prepared to correspond to all the kinds of radiator, a large number of stoppers are needed, so processes for managing components will be increased.

PRIOR ART DOCUMENT

Patent Document

Patent document 1: JP 2007-78306 A
Patent document 2: WO 2005/073654
Patent document 3: JP 2010-255868 A

SUMMARY

It is an object of the present disclosure to provide a heat exchanger mounting structure in which two heat exchangers can be mounted with less looseness irrespective of the size in front-rear interval.

Codes in parenthesis described in claims show a correspondence relationship with the concrete means described in embodiments later mentioned as one mode.

According to an example of the present disclosure, a heat exchanger mounting structure in which a first heat exchanger having a first core part in which heat exchange is performed between internal fluid and external fluid and a second heat exchanger having a second core part in which heat exchange is performed between internal fluid and external fluid are integrally mounted in a state where the first core part and the second core part are stacked with each other includes a bracket, a load supporting section, a fitting member and a contact section. The bracket is prepared in either one of the first heat exchanger and the second heat exchanger. The load supporting section is prepared in the other heat exchanger not having the bracket, and supports the load from the one of the heat exchangers having the bracket. The fitting member is prepared in the one of the heat exchangers having the bracket, and is fitted to the outer side of the load supporting section. The contact section contacts at least a part of the upper portion of the bracket.

Accordingly, the load of the one of the heat exchangers having the bracket is supported by the load supporting section prepared to the other heat exchanger. Furthermore, due to the load supporting section and the fitting member fitted to the outer side of the load supporting section, the load of the one of the heat exchangers having the bracket is supported in the up-and-down direction and in the left-and-right direction. Thereby, the heat exchangers can be assembled in the stabilized state in the up-and-down direction and the left-and-right direction. Furthermore, if one of the heat exchangers is deviated in a direction separating from or approaching to the other heat exchanger, at least a part of the bracket is pressed downward by the contact section. Thereby, if one of the heat exchangers is deviated in a direction separating from or approaching to the other heat exchanger, the deviation dimension is regulated by the contact section. Therefore, the attachment state of the heat exchangers is stabilized also in the front-and-rear direction of the heat exchangers, and the stable state can be maintained. Thus, the looseness can be reduced in the heat exchanger mounting structure irrespective of the size of front-and-rear interval between the two heat exchangers.

For example, the contact section is placed to the fitting member at a position located right above the load supporting section. Since the contact section presses down the fitting member which is in direct fitting to the load supporting section, the pressing force of the contact section can be efficiently transmitted to the heat exchanger having the bracket. Therefore, the deviation dimension of the heat exchanger can be further reduced.

For example, the contact surface of the contact section in contact with the upper surface of the bracket is equipped with a sloped surface which is sloped upward as extending toward the tip end of the contact surface. Thereby, while the heat exchangers are mounted, when a portion of the bracket which is pressed down by the contact section is place under the contact section, the portion of the bracket can be arranged smoothly by inserting from the tip end of the contact surface. Therefore, the workability of mounting the heat exchangers can be improved.

For example, the contact section has the contact surface in contact with the upper surface of the bracket, and a rib extending in a direction crossing the contact surface. According to this, the strength of the contact section itself can be improved.

For example, the heat exchanger mounting structure has a pressed part extending from the side surface of the bracket at a position lower than the upper end of the bracket, and the contact section presses down the pressed part from the upper side. According to this, since the contact section can be set at a lower position, components of the heat exchanger mounting structure can be downsized in the height direction.

DETAILED DESCRIPTION

Figure 1:
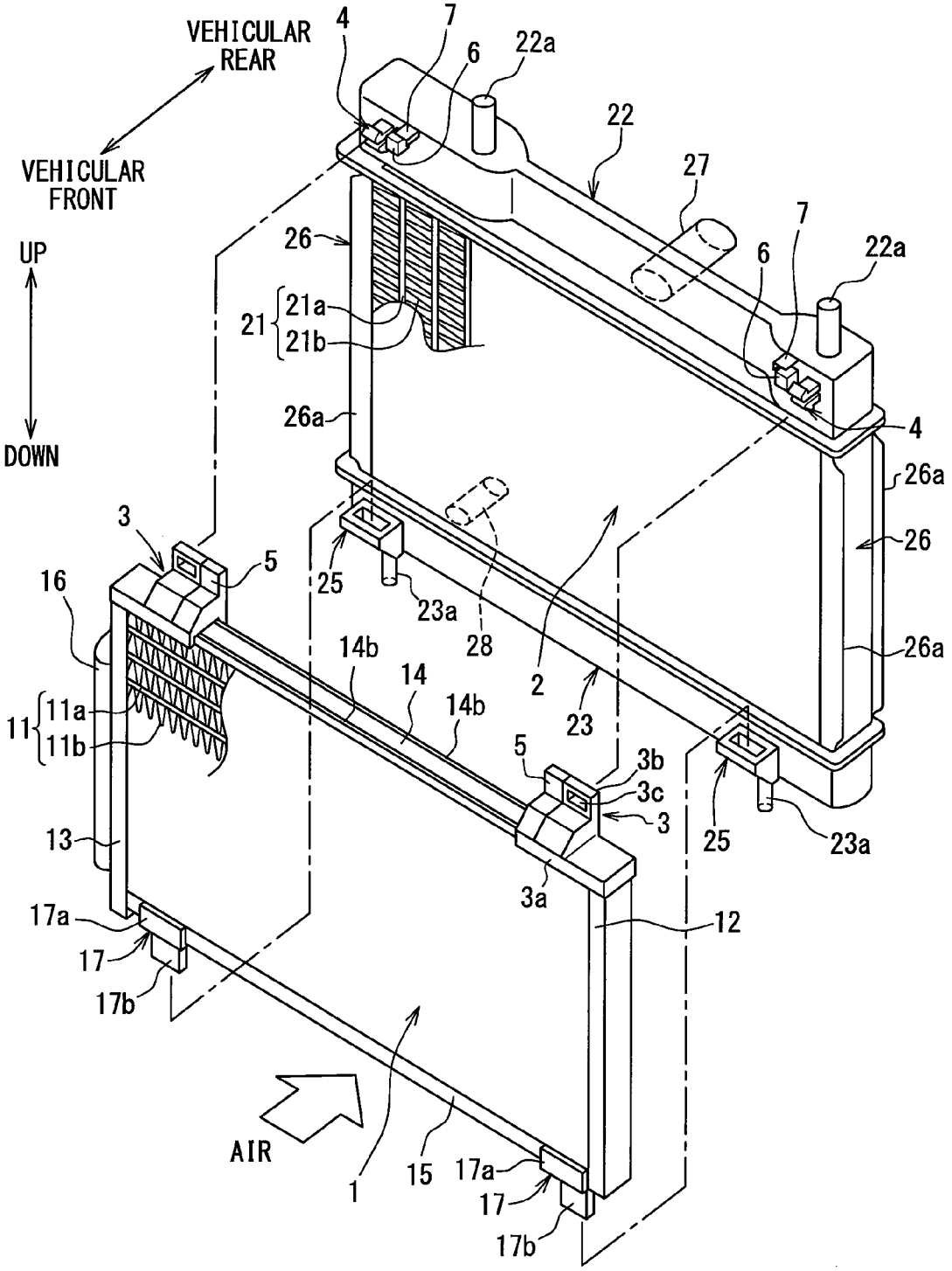
FIG. 1 is an exploded perspective view showing a schematic structure of mounting a condenser and a radiator according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
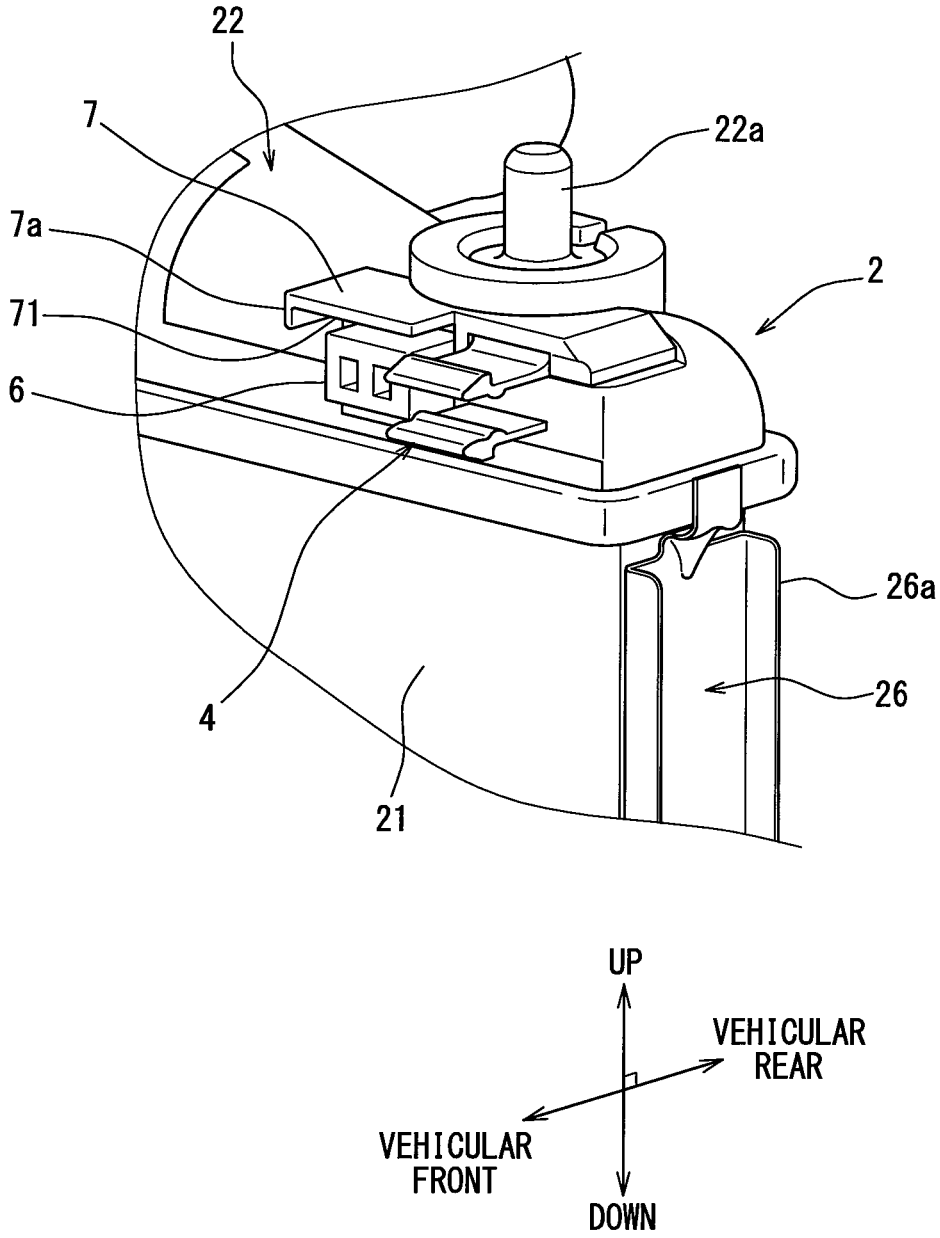
FIG. 2 is a partial perspective view explaining the structure of the radiator about the heat exchanger mounting structure of the first embodiment.
Figure 3:
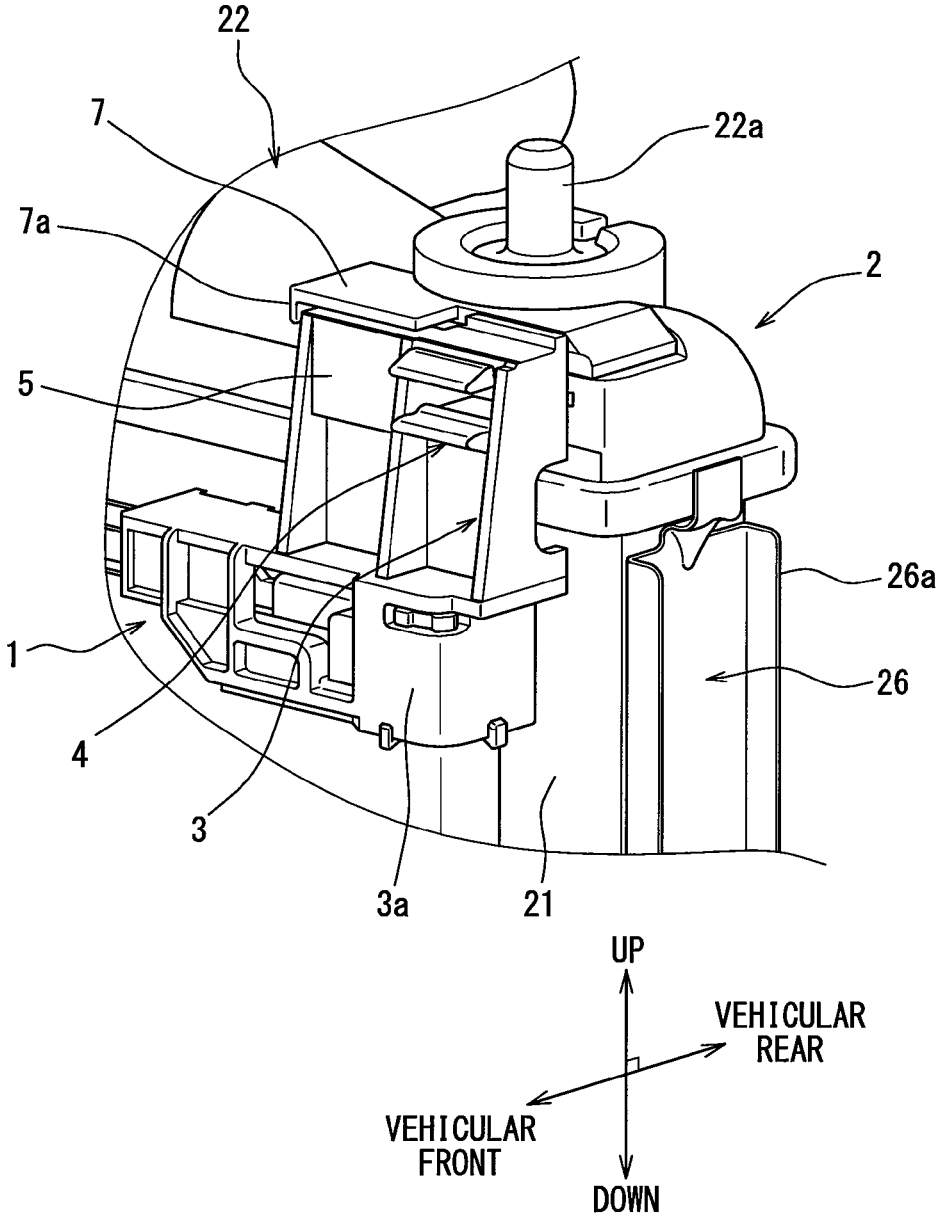
FIG. 3 is a partial perspective view explaining the structure of the condenser and the radiator about the heat exchanger mounting structure of the first embodiment.

A heat exchanger mounting structure according to a first embodiment of the present disclosure is explained with reference to FIGS. 1-8. The heat exchanger mounting structure of this embodiment relates to a structure of mounting heat exchangers arranged in a predetermined state certainly so that the heat exchange core parts oppose each other. FIG. 1 is an exploded perspective view illustrating a schematic structure of mounting a condenser 1 and a radiator 2 as example of two heat exchangers. FIG. 2 is an enlarged perspective view illustrating a partial structure of the radiator 2. FIG. 3 is an enlarged perspective view illustrating a partial structure of the condenser 1 and the radiator 2.

As shown in FIG. 1, the condenser 1 and the radiator 2 are disposed adjacent with each other in an engine compartment of a vehicle. The condenser 1 is an example of a first heat exchanger, and is arranged on the vehicular front side (front part of the engine compartment) or upstream side in a flow of air. The radiator 2 is an example of a second heat exchanger, and is arranged on the vehicular rear side or downstream of the condenser 1 in the flow of air. The condenser 1 and the radiator 2 are mounted in the vehicle such that a core part 11 for heat-exchange and a core part 21 for heat-exchange oppose with each other.

The condenser 1 and the radiator 2 are integrally assembled with an electric fan as a fan which compulsorily sends air (an example of external fluid) for exchanging heat with fluid flowing inside both of the core parts, and are mounted in the vehicle in this state. Thus, the condenser 1, the radiator 2, and the electric fan are integrally mounted to constitute a cooling module. In addition, the electric fan is not illustrated in FIG. 1. Air (outside air) is sent by the electric fan to the condenser 1 and the radiator 2 in a blank arrow direction, i.e., vehicular rearward, and each internal fluid in the condenser 1 and the radiator 2 is cooled by the sent air.

The condenser 1 is, for example, a heat exchanger equipped in a refrigerating cycle for air-conditioning the vehicle, and is connected to the discharge side of a compressor to cool refrigerant discharged from the compressor. The radiator 2 is a heat exchanger connected to a cooling-water circuit of the engine of the vehicle, and cools high-temperature cooling water which absorbs heat in the engine.

The condenser 1 includes the core part 11 (corresponding to a first core part) in which heat is exchanged between refrigerant (an example of internal fluid) flowing inside and air (an example of external fluid) flowing outside, and header tanks 12, 13 respectively disposed at the ends of the core part 11 in a width direction of the vehicle. The core part 11 has tubes 11*a* having flat cross-section to define refrigerant passage and fins 11*b* alternately stacked with each other in the up-and-down direction, which are integrally constructed by, for example, brazing. The fin 11*b* is a component which increases the heat transfer area between the refrigerant flowing inside the tube 11*a* and the air, and is, for example, a corrugated fin formed into a wave shape.

The header tanks 12, 13 are respectively disposed at the ends of the core part 11 in the width direction (left-and-right direction), and communicate with the inside of all the tubes 11*a*. The header tank 12, 13 has an approximately tube shape extending in a direction perpendicular to the longitudinal direction of the tube 11*a*, i.e., the up-and-down direction. The header tank 12, 13 has a plate adjacent to the core part, and the plate has multiple holes. The end part of the tube 11*a* is fitted into the hole, such that the inside of the header tank 12 and the inside of the header tank 13 communicate with each other through the tubes 11*a* fitted into.

An upper plate 14 and a lower plate 15 are respectively disposed to ends of the core part 11 in the up-and-down direction, i.e., in a stacking direction alternately stacking the tubes 11*a* and the fins 11*b*. The upper plate 14 and the lower plate 15 extend in the longitudinal direction of the tube 11*a* with the U-shaped cross-section, and are reinforcement component reinforcing the core part 11.

The peak part of the corrugated fin 11*b* located the highest in the core part 11 is joined to the bottom surface of the upper plate 14. The peak part of the corrugated fin 11*b* located the lowest in the core part 11 is joined to the upper surface of the lower plate 15. The end portions of the upper plate 14 and the lower plate 15 in the longitudinal direction is respectively joined and fixed to the header tank 12 and the header tank 13. The tip end part of the upper plate 14 in the longitudinal direction is fitted and joined to a groove portion formed in the header tank 12 and the header tank 13. Similarly, the tip end part of the lower plate 15 in the longitudinal direction is fitted and joined to a groove portion formed in the header tank 12 and the header tank 13.

The bracket 3 is received and held by the upper plate 14 by being fitted to the outer side, at each end portion in the width direction, on the upper end of the core part 11. The bracket 3 is arranged to be located adjacent to the upper end of the header tank 12 and adjacent to the upper end of the header tank 13. The bracket 3 includes a base 3*a* combined with the upper plate 14, an arm part 3*b* extending upward from the base 3*a*, and a fitting hole 3*c* passing through the arm part 3*b* in the thickness direction at the upper end portion. The bracket 3 is made of plastic material, metal material, etc.

Similarly, a bracket 17 is received and held by the lower plate 15 by being fitted to the outer side, at each end portion in the width direction, on the lower end of the core part 11. The bracket 17 is arranged to be located adjacent to the lower end of the header tank 12 and adjacent to the lower end of the header tank 13. The bracket 17 includes a base 17*a* combined with the lower plate 15, and a leg part 17*b* extending downward from the base 17*a*.

The bracket 3 disposed on the upper side of the core part 11 is integrally tightened to by a fitting structure between the arm part 3*b* and a fitting nail 4 located at a corresponding position on the upper side of the radiator 2. The fitting nail 4 is a nail part, for example, having two projections arranged in the up-and-down direction and is easy to have elastic deformation by an external force in the up-and-down direction, and corresponds to an engaging projection part. Specifically, the fitting nail 4 has two, e.g., upper and lower, fitting portions, each of which having a nail part at the tip end, and the two fitting portions are spaced from each other by a predetermined interval. An interval between the nail parts of the two fitting portions is changeable based on the elasticity of the metal material or the plastic material.

The fitting hole 3*c* of the bracket 3 has an inner periphery surface defining an engaging portion which is engaged with the fitting nail 4 corresponding to the engaging projection part. After the fitting nail 4 is inserted in the fitting hole 3*c* with a posture being closed on the inner side by the elastic deformation, the fitting nail 4 tries to open toward each of the upper side and the lower side so as to return to the original posture, thus, the fitting nail 4 is supported by the engaging portion. Such an engaging portion prepared in the bracket 3 constitutes a stopper part engaged with the fitting nail 4, and the fitting nail 4 disposed on the radiator 2 also constitutes a stopper part which is engaged with the arm part 3*b*, that is, the inner periphery surface of the fitting hole 3*c*. The stopper part serves to hold the condenser 1 relative to the radiator 2 in the front-and-rear direction of the vehicle. Moreover, an engaging projection part such as the fitting nail 4 may be provided to the bracket 3, in this case, an engaging portion such as the fitting hole 3*c* is provided to the radiator 2 to be engaged with the engaging projection part.

The load supporting section 6 is integrally formed in the header tank 22 of the radiator 2. For example, the load supporting section 6 is integrally formed to the radiator 2 at a position next to the fitting nail 4, and is a square-pillar-shaped protrusion part. The load supporting section 6 supports the load of the condenser 1 by fitting with the fitting member 5 disposed to the condenser 1 having the bracket 3.

The fitting member 5 includes a base combined with the upper plate 14, and an arm part extending upward from the base to constitute a fitting part. The fitting member 5 is formed at a position corresponding to the load supporting section 6, and is fitted to the outer side of the load supporting section 6. The fitting part of the fitting member 5 is a rectangular pipe component surrounding all the side surface of the square-pillar-shaped load supporting section 6, and the inner space is exposed at least relative to the radiator 2 (vehicular rear side). The fitting part having the rectangular pipe shape is defined by four sides, e.g., a top fitting part 51, a lower fitting part 52, a left side fitting part 52, and a right side fitting part 53. Moreover, the fitting member 5 is integrally formed with the bracket 3, in this case, the base of the fitting member 5 is integrally formed with the base 3*a* of the bracket 3. The fitting member 5 is made of plastic material, metal material, etc. similarly to the bracket. In addition, the fitting member 5 may be made of a component separate from the bracket 3.

The pressing part 7 (contact section) is a flat-plate component integrally provided to the radiator 2 with a predetermined interval (at least thickness dimension of the fitting part) from the upper surface of the load supporting section 6, and covers at least the upper surface of the load supporting section 6. That is, the pressing part 7 is a eave-shaped component provided above the load supporting section 6 and covers at least a part of the upper surface of the load supporting section 6. The pressing part 7 contacts the fitting member 5 from the upper side at a position right above the load supporting section 6, and serves to press down the fitting member 5. Thus, the load supporting section 6 supports the load of the condenser 1 transmitted from the fitting member 5. Furthermore, the pressing part 7 serves to control the displacement of the condenser 1 by pressing downward against the upward force applied to the fitting member 5. In other words, the pressing part 7 contacts at least a part of the bracket 3 from the upper side, and reduces the upward force of the bracket 3.

The pressing part 7 has a pressing surface 71 which contacts at least a part of the bracket 3 from the upper side, and a rib 7*a* extending in a direction intersecting the pressing surface 71 from the end portion of the pressing part. That is, the pressing part 7 is a component having an L-shaped cross-section. Due to the rib 7*a*, the strength of the pressing part 7 itself can be improved. Moreover, by the improvement in the strength, it is possible to reduce the area of the pressing surface 71 of the pressing part 7, thereby downsizing the heat exchanger mounting structure. In addition, the rib 7*a* may extend from a portion other than the end portion of the pressing part 7, and the rib may be one of a plurality of ribs arranged in a line.

The bracket 17 disposed on the lower part of the core part 11 is inserted in the support component 25 prepared on the lower part of the radiator 2, so as to regulate the position in the front-and-rear direction and to absorb a variation in the dimension in the up-and-down direction. The support component 25 has a box shape and the upper end is opened. The leg 17*b* of the bracket 17 is fitted to the opened upper end so as to be supported. The bracket 17 is made of a material such as metal or plastic having a certain elasticity and being excellent in wear resistance, for example, aluminum, its alloy, polypropylene, nylon, or polyacetal.

Moreover, an entrance pipe which is an entrance part for refrigerant flowing through the core part 11 is disposed at the rear side of the upper part of the header tank 12. An exit pipe which is an exit part for the refrigerant flowing through the core part 11 is disposed at the rear side of the lower part of the header tank 13. Furthermore, a gas-liquid separator 16 which separates refrigerant between gas and liquid is integrally joined to the header tank 13. Moreover, components which define the condenser 1 are made of, for example, aluminium alloy, and integrally joined with each other by brazing.

The radiator 2 has the core part 21 in which heat exchange is performed between water (an example of internal fluid) which flows inside and air (an example of external fluid) which flows outside, and the header tanks 22 and 23 respectively disposed at the ends of the core part 21 (corresponding to a second core part) in the up-and-down direction. The core part 21 includes the tubes 21*a* having flat cross-section defining the water passage and the fins 21*b* alternately stacked with each other in the up-and-down direction, similarly to the core part 11 of the condenser 1, and united, for example, by brazing. The fin 21*b* is a component which increases the heat transfer area like the fin 11*b*, and has, for example, corrugated shape.

A core plate which joins and supports all of the ends of the tubes 21*a* is arranged at each end of the core part 21 in the up-and-down direction. The header tanks 22 and 23 are integrally formed with the core plate, and the interior space of the header tank 22, 23 communicates with inside of all the tubes 21*a*. That is, the header tank 22 and the header tank 23 communicate with each other through the tube 21*a*. Moreover, the header tank 22, 23 has an approximately pipe shape extending in a direction perpendicular to the longitudinal direction of the tube 21*a* (vehicular width direction), and is made of plastic excellent in heat resistance such as nylon.

The side plate 26 is disposed to each side of the core part 21 in the vehicular width direction (left-and-right direction), which is further outer side of the fin 21*b* located on the most outer side in the vehicular width direction. The side plate 26 is a reinforcement component which reinforces the core part 11. The side plate 26 has a base part opposing the side part of the core part 21, and a rib 26*a* projected in a direction perpendicular to the base part, at both sides in the front-and-rear direction. The side plate 26 has a U-shaped cross-section extending in the longitudinal direction of the tube 21*a*.

The entrance pipe 27 for engine cooling water, the boss part 22*a* for attaching to the vehicle chassis, etc. other than the fitting nail 4, the load supporting section 6, and the pressing part 7 are integrally formed with the upper header tank 22. The exit pipe 28 for engine cooling water, the boss part 23*a* for attaching to the vehicle chassis, etc. other than the support component 25 are integrally formed with the lower header tank 23. Moreover, in the radiator 2, the tube 21*a*, the fin 21*b*, the core plate, and the side plate 26 of the core part 21 are made of, for example, aluminium alloy and are integrally joined to one by brazing.

Figure 4:
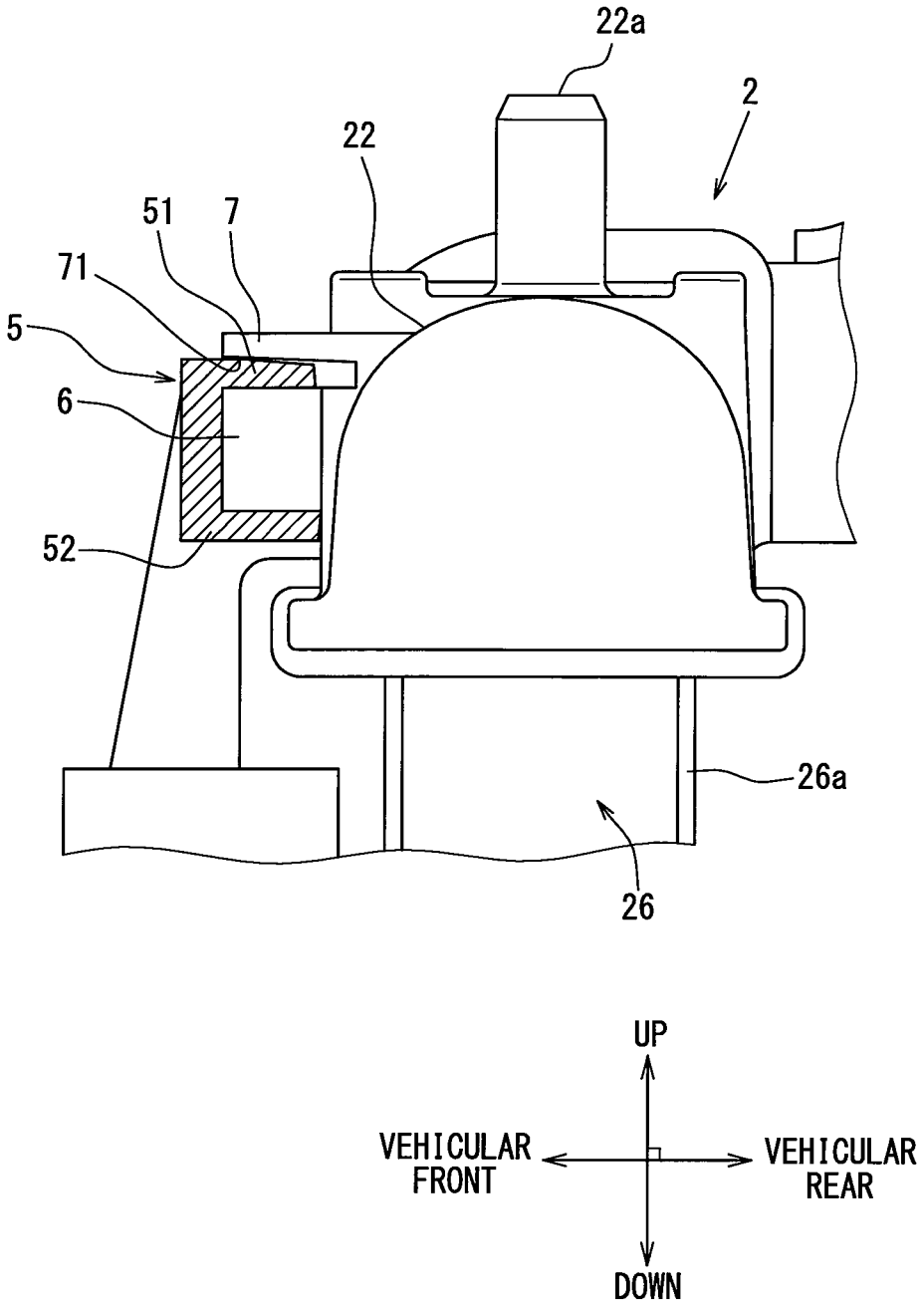
FIG. 4 is an enlarged view explaining the relationship among a fitting member, a load supporting section, and a contact section of the first embodiment.

FIG. 4 is an enlarged view illustrating the relationship among the fitting member 5, the load supporting section 6, and the pressing part 7. In FIG. 4, the fitting member 5 is shown in the cross-section, and the load supporting section 6 and the pressing part 7 are engaged with each other through the fitting member 5.

As shown in FIG. 4, in the state where the condenser 1 and the radiator 2 are put together, the top fitting part 51 and the lower fitting part 52 of the fitting member 5 having the U-shaped cross-section are fitted on the outer side of the upper surface and the lower surface of the load supporting section 6, respectively. Furthermore, the left side fitting part 53 and the right side fitting part 54 opposing with each other of the fitting member 5 are fitted on the outer side of side surfaces of the load supporting section 6, respectively. The condenser 1 receives gravity force by the self-weight downward in the vertical direction. Therefore, in the state where the fitting member 5 is fitted to the outer side of the load supporting section 6, the undersurface of the top fitting part 51 contacts to press down the upper surface of the load supporting section 6, and a clearance is generated between the upper surface of the lower fitting part 52 and the undersurface of the load supporting section 6. Furthermore, the upper surface of the top fitting part 51 contacts the undersurface (i.e., the pressing surface 71) of the pressing part 7, partially or as a whole, thus, the top fitting part 51 is supported between the pressing part 7 and the load supporting section 6.

Operations for attaching the condenser 1 to the radiator 2 according to the present embodiment is explained. First, as a preparation process for assembling the heat exchangers, the upper bracket 3, the lower bracket 17 and the fitting member 5 are attached to the condenser 1. Because the bracket 3 and the fitting member 5 are made of one component, the attachment of the bracket 3 and the fitting member 5 is completed by attaching the bracket 3 to the condenser. In case where the upper bracket 3 and the lower bracket 17 are simultaneously arranged to adjacency of the upper end part of the header tank 12, 13 and the lower end part of the header tank 12, 13, respectively, of the condenser 1, the arrangement position of the upper bracket 3 and the lower bracket 17 is specified with a jig device. Thereby, the upper and lower brackets are arranged to have appropriate engagement relative to the fitting nail 4 and the support component 25, respectively, of the radiator 2.

Then, the leg part 17*b* of the lower bracket 17 of the condenser 1 is inserted and fitted in the concave portion of the support component 25 of the radiator 2 at the same time on the right side and the left side. The upper part of the condenser 1 is made to be close to the radiator 2 using the fitted structure as a fulcrum, and the upper bracket 3 is engaged with the fitting nail 4 so that the fitting nail 4 of the radiator 2 is fitted to the fitting hole 3*c* at the same time on the right side and the left side. Thereby, the condenser 1 is connected to the radiator 2 in the state where the movement in the front-and-rear direction is regulated, due to the engagement between the engaging projection part (fitting nail 4) and the engaging portion to which the engaging projection part is engaged. Thus, the condenser 1 and the radiator 2 are mounted to the vehicle as an integral-type heat exchanger.

In case two heat exchangers such as the condenser 1 and the radiator 2 are assembled in the front-and-rear direction, looseness may arise depending on the use situation. The looseness may take place, for example, when the condenser 1 moves to deviate vehicular frontward or rearward relative to the radiator 2. The looseness may cause vibration, abnormal noise, wear in the bracket, the fitting structure, and the other parts, or damage by collision among the components such as fin of the heat exchanger. The heat exchanger mounting structure according to the present disclosure contributes to solving the above-mentioned subject.

Figure 5:
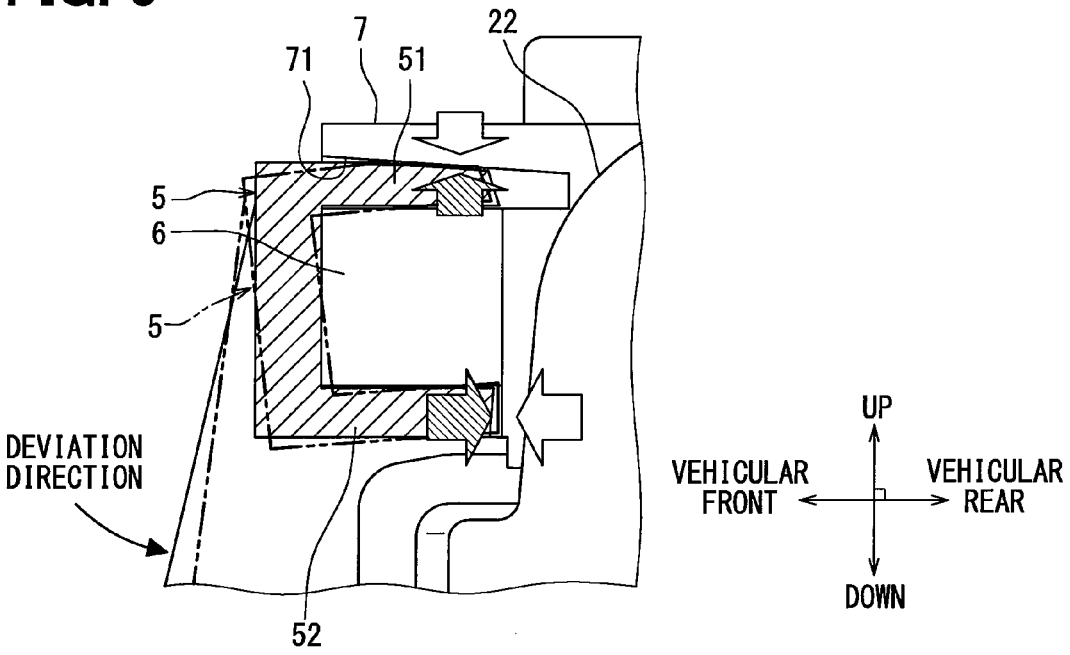
FIG. 5 is an enlarged view explaining state of the fitting member, the load supporting section, and the contact section in case the condenser is deviated rearward in the heat exchanger mounting structure of the first embodiment.

For example, when the condenser 1 deviates rearward relative to the radiator 2, as shown in FIG. 5, in accordance with an inclination of the condenser 1, the rear side of the fitting member 5 is raised, and the front side of the fitting member 5 is lowered, such that characteristic force acts between the components. In FIG. 5, the fitting member 5 in the rearward deviating state is shown by the double chain line. In this state, the upper surface of the rear portion of the top fitting part 51 is in contact with the rear portion of the pressing surface 71 of the pressing part 7, and a clearance may be generated between the upper surface of the top fitting part 51 and the pressing surface 71, on the front side. Thus, the top fitting part 51 comes to incline relative to the pressing part 7.

At this time, on the vehicular rear side, the upper surface of the top fitting part 51 acts to press the undersurface of the pressing part 7 upward (hatched arrow direction in FIG. 5). On the other hand, the pressing surface 71 of the pressing part 7 produces the reaction force (blank arrow direction in FIG. 5) which pushes back the upper surface of the top fitting part 51, such that the movement of the fitting member 5 is regulated by restraining and suppressing the top fitting part 51 downward, as a result, the fitting member 5 is restricted from moving. Moreover, the rear end portion of the lower fitting part 52 acts to press the radiator 2 (hatched arrow direction in FIG. 5). On the other hand, the radiator 2 produces the reaction force (blank arrow direction in FIG. 5) which pushes back the lower fitting part 52, thus, the fitting member 5 is restricted from moving.

Figure 6:
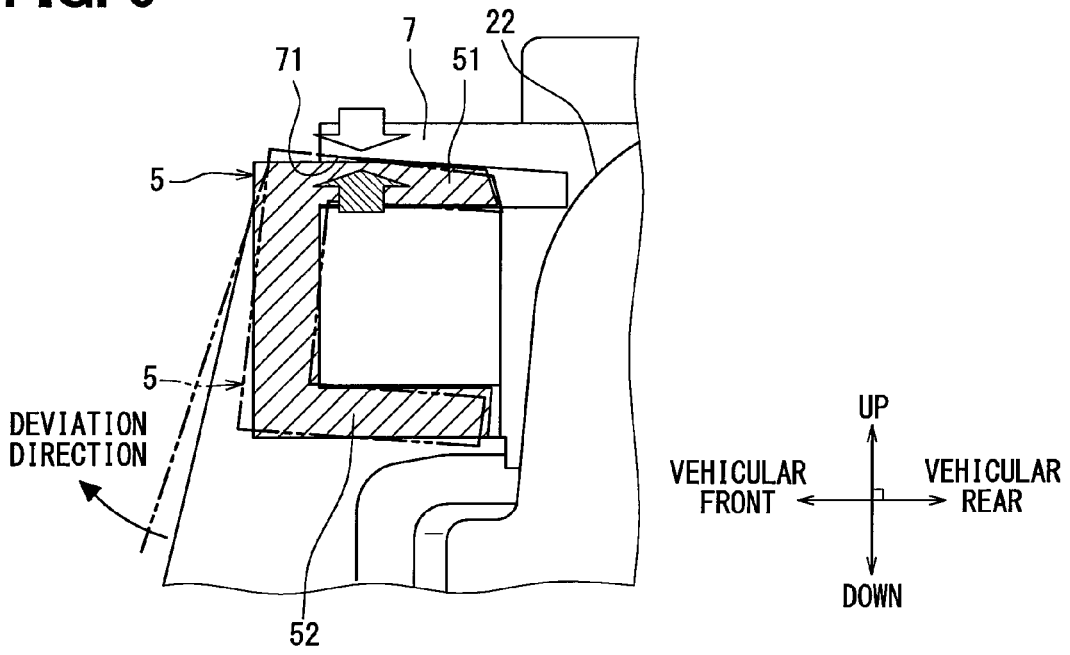
FIG. 6 is an enlarged view explaining state of the fitting member, the load supporting section, and the contact section in case the condenser is deviated frontward in the heat exchanger mounting structure of the first embodiment.

Moreover, in case where the condenser 1 moves to deviate frontward relative to the radiator 2, as shown in FIG. 6, in accordance with an inclination of the condenser 1, the rear side of the fitting member 5 is lowered, and the front side of the fitting member 5 is raised, such that characteristic force acts between the components. In FIG. 6, the fitting member 5 in the frontward deviating state is shown by the double chain line. In this state, the upper surface of the front portion of the top fitting part 51 is in contact with the front portion of the pressing surface 71 of the pressing part 7, and a clearance is generated between the upper surface of the top fitting part 51 and the pressing surface 71, on the rear side. Thus, the top fitting part 51 comes to incline relative to the pressing part 7.

At this time, on the front side, the upper surface of the top fitting part 51 acts to press the undersurface of the pressing part 7 (hatched arrow direction in FIG. 6). On the other hand, the pressing surface 71 of the pressing part 7 produces the reaction force (blank arrow direction in FIG. 6) which pushes back the upper surface of the top fitting part 51, such that the movement of the fitting member 5 is regulated by restraining and suppressing the top fitting part 51 downward, as a result, the fitting member 5 is restricted from moving.

Figure 7:
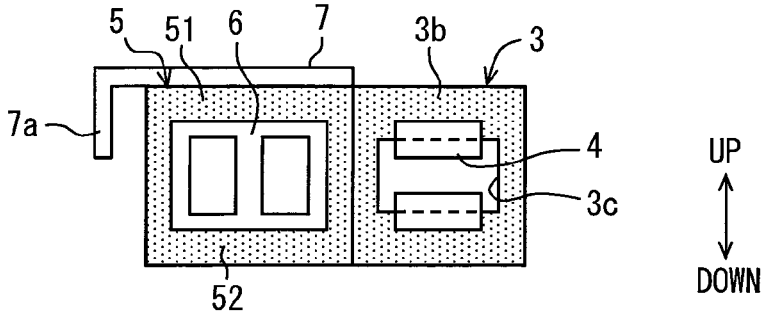
FIG. 7 is a front view explaining the relationship among the bracket, the fitting member, the load supporting section, and the contact section in the first embodiment.

Furthermore, when the bracket 3, the fitting member 5, the load supporting section 6, and the pressing part 7 are seen vehicular rearward, there is a positional relationship shown in FIG. 7. As shown in FIG. 7, the pressing part 7 suppresses the whole of the top fitting part 51 in the vehicular width direction (left-and-right direction of FIG. 7) from the upper side while a force is applied to the top fitting part 51 from the load supporting section 6. In this state, the pressing part 7 works as a top plate part which controls the looseness in the condenser 1.

Figure 8:
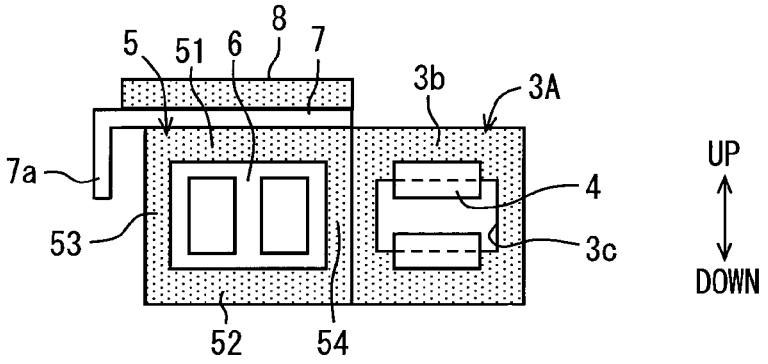
FIG. 8 is a front view explaining other example of the first embodiment further equipped with a top plate part on the contact section.

Next, other example which is further equipped with a top plate part 8 on the pressing part 7 is explained with reference to FIG. 8. As shown in FIG. 8, the top plate part 8 is integrally formed with the bracket 3A and the fitting member 5, as a single component. The top plate part 8 produces the reaction force which pushes back the pressing part 7, so as to suppress the pressing part 7 downward to regulate the movement of the fitting member 5, such that the fitting member 5 is restricted from moving. That is, the top plate part 8 in FIG. 8 is a component which exhibits the same function as the pressing part 7 of FIGS. 5-7. The other example shown in FIG. 8 represents a case where the pressing part 7 is provided to the condenser 1.

According to the other example, if the top plate part 8 is damaged by secular use, it is easy to replace the fitting members 5 which is separated from the condenser 1. For this reason, the influence on the heat exchanger by the breakage in the top plate part 8 is small. For example, since the top plate part 8 is not integrally formed with the radiator 2, there is no fear of resulting in breakage of the radiator 2, for example, there is no problem which develops into breakage or fault such as water leak from the tank part.

Effect and advantage of the heat exchanger mounting structure according to the first embodiment is described. The heat exchanger mounting structure includes: the bracket 3 provided to the condenser 1; the engaging portion, e.g., the arm part 3*b* provided to the bracket 3 to be engaged with the fitting nail 4; the load supporting section 6 provided to the radiator 2 not having the bracket 3 to support a load from the condenser 1; the fitting member 5 provided to the bracket 3 and fitted to the outer side of the load supporting section 6; and the contact section 7 in contact with at least a part of an upper portion of the bracket 3 to control the upward force of the bracket 3.

According to the heat exchanger mounting structure, the load of the condenser 1 which is a first heat exchanger having the bracket 3 is supported by the load supporting section 6 prepared in the radiator 2 which is a second heat exchanger. Furthermore, the load supporting section 6 and the fitting member 5 which is fitted to the outer side of the load supporting section can support the load of the condenser 1 in the up-and-down direction and in the left-and-right direction. Thereby, the condenser 1 and the radiator 2 are assembled with each other in the stabilized state in the up-and-down direction and in the left-and-right direction.

Furthermore, if the condenser 1 is deviated in a direction separating from or approaching to the radiator 2, at least a part of the bracket 3 is pressed downward by the pressing part 7. Therefore, if the condenser 1 is deviated in the direction separating from or approaching to the radiator 2, the deviation can be controlled by the pressing part 7, such that the both heat exchangers in the assembled state is stabilized in the front-and-rear direction, further it is possible to maintain the stabilized state. Moreover, in case where the interval between the two heat exchangers in the front-and-rear direction is different, the assembling can be achieved by restricting the looseness. Therefore, the mounting structure can be applied to a variety of combinations of heat exchangers.

Moreover, according to the heat exchanger mounting structure of the first embodiment, damage in the fin of heat exchanger can be reduced, so it is possible to improve the product quality and to increase the product life.

Moreover, the pressing part 7 contacts and presses down a part of the fitting member 5 which is located right above the load supporting section 6, from the upper side. The pressing part 7 directly presses down the fitting member fitted to the load supporting section 6, so it is possible to efficiently transmit the pressing force of the pressing part 7 to the condenser 1.

Moreover, the pressing surface 71 of the pressing part 7 which contacts the fitting member 5 from the upper side has the sloped surface sloped upward as going toward the tip end of the pressing surface. Therefore, the assembling can be made easier, when the pressing part 7 is placed at a predetermined position relative to the fitting member 5, because it is easy to position the top fitting part 51 to be pressed down by the pressing part 7 under the pressing part 7. That is, the top fitting part 51 can be smoothly placed from the tip end toward the inner side of the pressing surface 71. Therefore, the workability assembling the heat exchangers can be improved.

Second Embodiment

Figure 9:
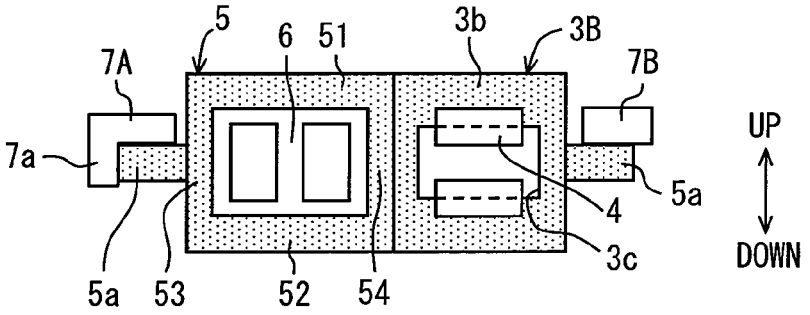
FIG. 9 is a front view explaining the relationship among a bracket, a fitting member, a load supporting section, a pressed part, and a contact section according to a second embodiment.
Figure 10:
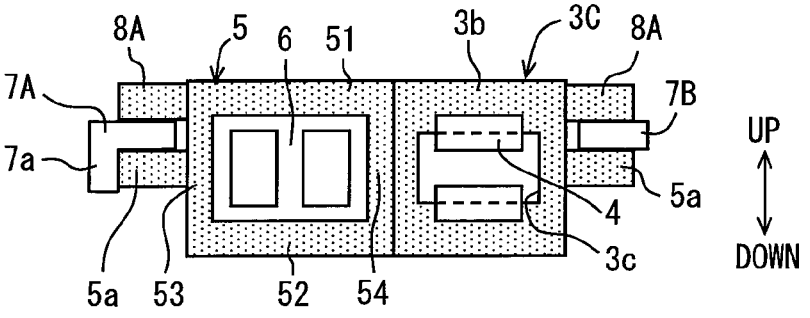
FIG. 10 is a front view explaining other example of the second embodiment further equipped with a top plate part on the contact section.

A second embodiment is a modification example of the heat exchanger mounting structure of the first embodiment, and is explained using FIG. 9 and FIG. 10. FIG. 9 is a front view explaining the relationship among the bracket 3B, the fitting member 5, the load supporting section 6, the pressed part 5*a*, and the pressing part 7A and the pressing part 7B in the second embodiment. FIG. 10 is a front view explaining other example further equipped with the top plate part 8A on the pressing part 7A shown in FIG. 9. The components having the same mark and code as the first embodiment in FIG. 9 and FIG. 10 are similar components having the same operation and the same effect.

As shown in FIG. 9, the heat exchanger mounting structure of the second embodiment has the pressed part 5*a* which is pressed down by the pressing part 7A, 7B from the upper side. The pressed part 5*a* is located at a position lower than the upper end of the bracket 3B, and integrally extends from the bracket 3B on both sides.

The pressing part 7A is provided to the radiator 2, and the undersurface contacts the upper surface of the pressed part 5*a* extending from a first side surface. The pressing part 7B is provided to the radiator 2, and the undersurface contacts the upper surface of the pressed part 5*a* extending from a second side surface. The pressing part 7A has a rib 7*a* extending from the end of the pressing part, which contacts at least a part of the bracket 3B from the upper side, in a direction intersecting the pressing surface. That is, the pressing part 7A has an L-shaped cross-section.

For example, when the condenser 1 deviates vehicular frontward or rearward relative to the radiator 2, the pressing part 7A, 7B produces the reaction force which pushes back the pressed part 5*a*, such that the pressed part 5*a* is suppressed and restrained downward, that is, the movement of the fitting member 5 is regulated. Thus, the fitting member 5 is restricted from deviating.

Next, other example of the second embodiment which further has the top plate part 8A on the pressing part 7A, 7B is explained with reference to FIG. 10. As shown in FIG. 10, the top plate part 8A is integrally formed with the bracket 3C and the fitting member 5, as a single component. The top plate part 8A produces the reaction force which pushes back the pressing part 7A, 7B. The pressing part 7A, 7B is suppressed downward and restrained so that a movement of the fitting member 5 is regulated, thus, the fitting member 5 is restricted from moving. That is, the top plate part 8A in FIG. 10 is a component which exhibits a function similar to the pressing part 7 of FIGS. 5-7. The other example shown in FIG. 10 may be equivalent to a case where the pressing part 7A, 7B is provided to the condenser 1. The top plate part 8A generates the same action and effect as the top plate part 8 of the first embodiment.

According to the second embodiment, since the pressing part 7A, 7B can be located at low position, the heat exchanger mounting structure can be downsized in the height. Therefore, it can be made easy to be mounted to the vehicle.

Third Embodiment

Figure 11:
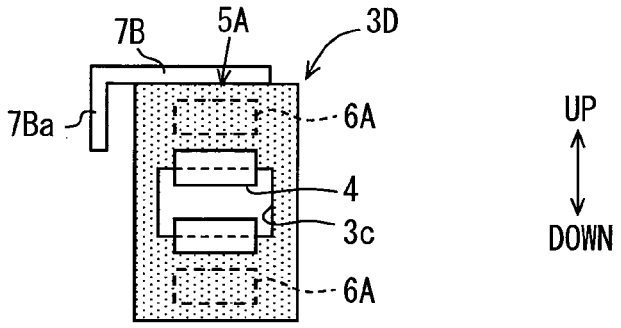
FIG. 11 is a front view explaining the relationship among a bracket, a fitting member, a load supporting section, and a contact section according to a third embodiment.
Figure 12:
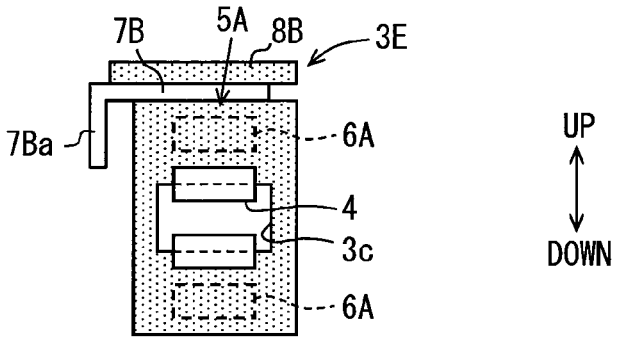
FIG. 12 is a front view explaining other example of the third embodiment further equipped with a top plate part on the contact section.

A third embodiment is a modification example of the heat exchanger mounting structure of the first embodiment, and is explained using FIG. 11 and FIG. 12. FIG. 11 is a front view explaining the relationship among the bracket 3D, the fitting member 5A, the load supporting section 6A, and the pressing part 7B in the third embodiment. FIG. 12 is a front view explaining other example further having the top plate part 8B on the pressing part 7B shown in FIG. 11. The components having the same mark and code as the first embodiment in FIG. 11 and FIG. 12 are similar components having the same operation and the same effect.

As shown in FIG. 11, the fitting nail 4 and the load supporting section 6A are arranged in the up-and-down direction. The load supporting section 6A is disposed at each of the upper side and the lower side of the fitting nail 4. The fitting member 5A surrounds each of the upper load supporting section 6A and the lower load supporting section 6A, and is fitted to the outer side. The fitting hole 3*c* is defined between the upper load supporting section 6A and the lower load supporting section 6A. That is, the bracket 3D is long in the up-and-down direction, and integrally has the fitting member 5A which is defined by the peripheral part as a fitting part. The pressing part 7B contacts the upper surface of bracket 3D integrally having the fitting member 5A from the upper side, and presses down the fitting member 5A. The pressing part 7B has a rib 7Ba extending in the direction crossing the pressing surface from the end of the pressing part which contacts at least a part of the bracket 3D from the upper side.

As shown in FIG. 12, the top plate part 8B is integrally formed with the bracket 3E and the fitting member 5A, as a single component. The top plate part 8B produces the reaction force which pushes back the pressing part 7B. The pressing part 7B is suppressed downward and restrained so that a motion of the fitting member 5A is regulated, so the fitting member 5A is restricted from moving. That is, the top plate part 8B in FIG. 12 is a component which exhibits the same function as the top plate part 8 of the first embodiment. The other example shown in FIG. 12 is equivalent to a case where the pressing part 7B is provided to the condenser 1.

Fourth Embodiment

Figure 13:
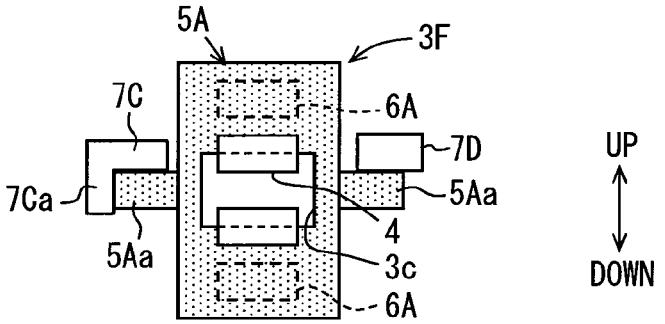
FIG. 13 is a front view explaining the relationship among a bracket, a fitting member, a load supporting section, a pressed part, and a contact section according to a fourth embodiment.
Figure 14:
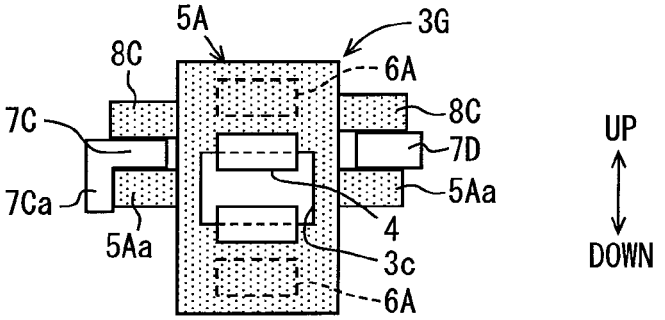
FIG. 14 is a front view explaining other example of the fourth embodiment further equipped with a top plate part on the contact section.

A fourth embodiment is a modification example of the heat exchanger mounting structure of the third embodiment, and is explained using FIG. 13 and FIG. 14. FIG. 13 is a front view explaining the relationship among the bracket 3F, the fitting member 5A, the load supporting section 6A, the pressed part 5Aa and the pressing part 7C, 7D in the fourth embodiment. FIG. 14 is a front view explaining other example further having the top plate part 8C on the pressing part 7C, 7D shown in FIG. 13. The components having the same mark and code as the first embodiment and the third embodiment in FIG. 13 and FIG. 14 are similar components having the same operation and the same effect.

As shown in FIG. 13, the heat exchanger mounting structure of the fourth embodiment has the pressed part 5Aa which is pressed down by the pressing part 7C, 7D from the upper side. The pressed part 5Aa extends from both side surfaces of the bracket 3F at the position lower than the upper end of the bracket 3F, and is a component integrally formed with the bracket 3F.

The pressing part 7C is formed in the radiator 2, and the undersurface contacts the upper surface of the pressed part 5Aa extending from a first side surface. The pressing part 7D is formed in the radiator 2, and the undersurface contacts the upper surface of the pressed part 5Aa extending from a second side surface. The pressing part 7C has a rib 7Ca extending in the direction crossing the pressing surface from the end of the pressing part of the bracket 3F which contacts at least a part of the bracket 3F from the upper side. That is, the pressing part 7C has an L-shaped cross-section.

For example, when the condenser 1 deviates vehicular frontward or rearward relative to the radiator 2, the pressing part 7C, 7D produces the reaction force which pushes back the pressed part 5Aa. The pressed part 5Aa is suppressed downward and restrained so that a movement of the fitting member 5A is regulated. The fitting member 5A is restricted from moving.

Next, other example of the fourth embodiment which further has the top plate part 8C on the pressing part 7C, 7D, and is explained with reference to FIG. 14. As shown in FIG. 14, the top plate parts 8C is integrally formed with the bracket 3G and the fitting member 5A, as a single component. The top plate part 8C produces the reaction force which pushes back the pressing part 7C, 7D. The pressing part 7C, 7D is suppressed downward and restrained so that a movement of the fitting member 5A is regulated. The fitting member 5A is restricted from moving. That is, the top plate part 8C in FIG. 14 is a component which exhibits a similar function as the pressing part 7 of FIGS. 5-7. The other example shown in FIG. 14 is equivalent to a case where the pressing part 7C, 7D are provided in the condenser 1. The top plate part 8C generates the same action and effect as the top plate part 8A of the second embodiment.

Fifth Embodiment

Figure 15:
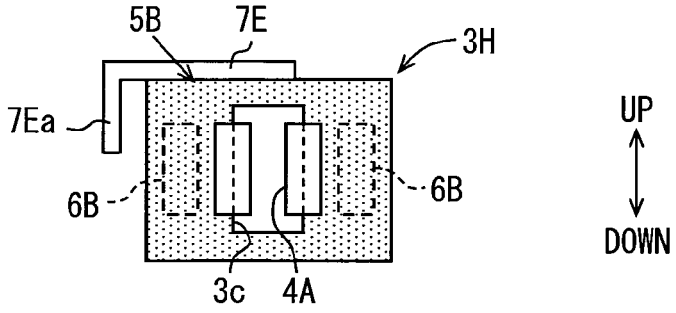
FIG. 15 is a front view explaining the relationship among a bracket, a fitting member, a load supporting section, and a contact section according to a fifth embodiment.
Figure 16:
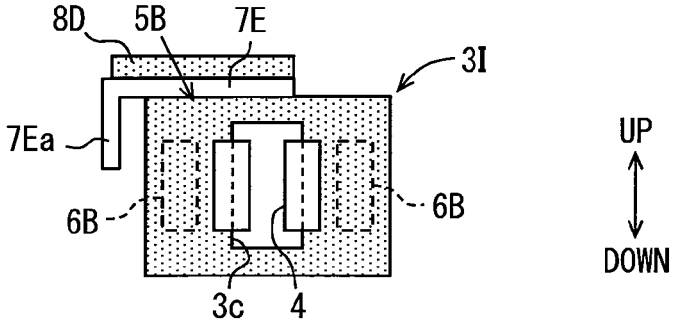
FIG. 16 is a front view explaining other example of the fifth embodiment further equipped with a top plate part on the contact section.

A fifth embodiment is a modification example of the heat exchanger mounting structure of the first embodiment, and is explained using FIG. 15 and FIG. 16. FIG. 15 is a front view explaining the relationship among the bracket 3H, the fitting member 5B, the load supporting section 6B, and the pressing part 7E in the fifth embodiment. FIG. 16 is a front view explaining other example further has the top plate part 8D on the pressing part 7E shown in FIG. 15. The components having the same mark and code as the first embodiment in FIG. 15 and FIG. 16 are similar components having the same operation and the same effect.

As shown in FIG. 15, the fitting nail 4A and the load supporting section 6B are arranged in the right and left direction (in the vehicular width direction). The load supporting section 6B is disposed to each of the left side and the right side of the fitting nail 4, and the fitting member 5B surrounds each the load supporting section 6B and is fitted to the outer side. The fitting hole 3*c* is formed between the left load supporting section 6B and the right load supporting section 6B. That is, the bracket 3H is a component long in the left-and-right direction, and integrally has the fitting member 5B in which the peripheral part corresponds to a fitting part. The pressing part 7E contacts the upper surface of the bracket 3H integrally having the fitting member 5B from the upper side, and presses down the fitting member 5B. The pressing part 7E has a rib 7Ea extending in the direction crossing the pressing surface from the end of the pressing part which contacts at least a part of the bracket 3H from the upper side.

As shown in FIG. 16, the top plate parts 8D is integrally formed with the bracket 3I and the fitting member 5B, as a single component. The top plate part 8D produces the reaction force which pushes back the pressing part 7E. The pressing part 7E is suppressed downward and restrained so that a movement of the fitting member 5B is regulated. The fitting member 5B is restricted from moving. That is, the top plate part 8D in FIG. 16 is a component which exhibits the same function as the top plate part 8 of the first embodiment. The other example shown in FIG. 16 is equivalent to a case where the pressing part 7E is provided to the condenser 1.

Sixth Embodiment

Figure 17:
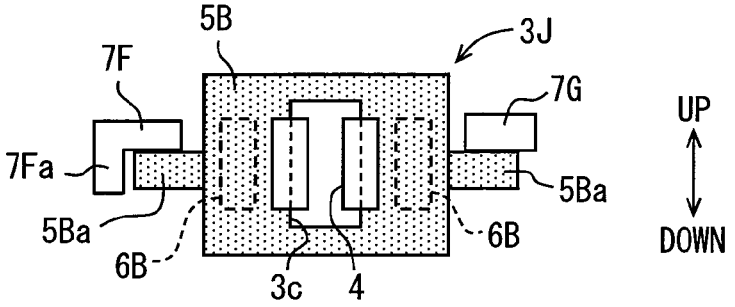
FIG. 17 is a front view explaining the relationship among a bracket, a fitting member, a load supporting section, a pressed part, and a contact section according to a sixth embodiment.
Figure 18:
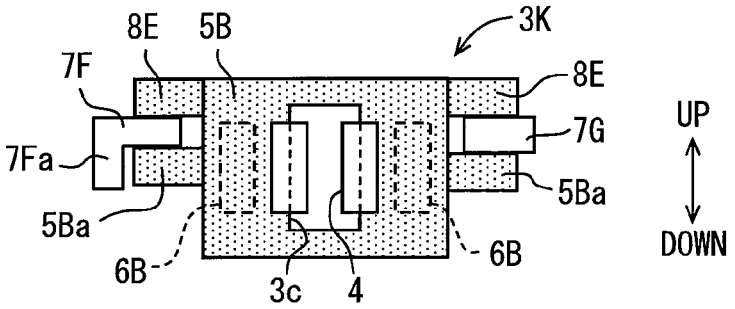
FIG. 18 is a front view explaining other example of the sixth embodiment further equipped with a top plate part on the contact section.

A sixth embodiment is a modification example of the heat exchanger mounting structure of the fifth embodiment, and is explained using FIG. 17 and FIG. 18. FIG. 17 is a front view explaining the relationship among the bracket 3J, the fitting member 5B, the load supporting section 6B, the pressed part 5Ba and the pressing part 7F, 7G in the sixth embodiment. FIG. 18 is a front view explaining other example further having the top plate part 8E on the pressing part 7F, 7G shown in FIG. 17. The components having the same mark and code as the first embodiment and the fifth embodiment in FIG. 17 and FIG. 18 are similar components having the same operation and the same effect.

As shown in FIG. 17, the heat exchanger mounting structure of the sixth embodiment has the pressed part 5Ba which is pressed down by the pressing part 7F, 7G from the upper side. The pressed part 5Ba extends from both side surfaces of the bracket 3J at the position lower than the upper end of the bracket 3J, and is a component integrally formed with the bracket 3J.

The pressing part 7F is formed in the radiator 2, and the undersurface contacts the upper surface of the pressed part 5Ba extending from the first side surface. The pressing part 7G is formed in the radiator 2, and the undersurface contacts the upper surface of the pressed part 5Ba extending from the second side surface. The pressing part 7F has a rib 7Fa extending in the direction crossing the pressing surface from the end of the pressing part which contacts at least a part of the bracket 3J from the upper side. That is, the pressing part 7F has an L-shaped cross-section.

For example, when the condenser 1 is deviated vehicular rearward or frontward relative to the radiator 2, the pressing part 7F, 7G produces the reaction force which pushes back the pressed part 5Ba. The pressed part 5Ba is suppressed downward and restrained so that a movement of the fitting member 5B is regulated. The fitting member 5B is restricted from moving.

Next, other example of the sixth embodiment which further has the top plate part 8E on the pressing part 7F, 7G, and is explained with reference to FIG. 18. As shown in FIG. 18, the top plate parts 8E is integrally formed with the bracket 3K and the fitting member 5B, as a single component. The top plate part 8E produces the reaction force which pushes back the pressing part 7F, 7G. The pressing part 7F, 7G is suppressed downward and restrained so that a movement of the fitting member 5B is regulated. The fitting member 5B is restricted from moving. That is, the top plate part 8E in FIG. 18 is a component which exhibits a similar function as the pressing part 7 of FIGS. 5-7. The other example shown in FIG. 18 is equivalent to a case where the pressing part 7F, 7G is provided in the condenser 1. The top plate part 8E generates the same action and effect as the top plate part 8A of the second embodiment.

Other Embodiment

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

In the above embodiments, the bracket 3 and the bracket 17 are not limited to be disposed to the condenser 1 which corresponds to a first heat exchanger. The bracket 3 and the bracket 17 may be provided to the radiator 2 which corresponds to a second heat exchanger, for example, in an embodiment to which the present disclosure is applied.

Moreover, the bracket in the above embodiments is not limited to a structure which is separate from and is assembled to a heat exchanger such as the condenser 1 and the radiator 2, and may be integrally formed with the heat exchanger.

The invention claimed is:

1. A heat exchanger mounting structure, in which a first heat exchanger having a first core part and a second heat exchanger having a second core part are mounted together while the first core part and the second core part are stacked with each other, heat being exchanged between an internal fluid and an external fluid in the first core part, heat being exchanged between an internal fluid and the external fluid in the second core part, comprising:

a bracket provided to one of the first heat exchanger and the second heat exchanger;

a pair of engaging projection parts provided to one of the bracket and the other heat exchanger to which the bracket is not provided;

a single engaging portion provided to the other of the bracket and the other heat exchanger to be combined with the pair of engaging projection parts;

a load supporting section provided to the other heat exchanger, to which the bracket is not provided, to support a load from the one of the first heat exchanger and the second heat exchanger, the load supporting section being provided adjacent but not between the pair of engaging projection parts;

a fitting member provided to the one of the first heat exchanger and the second heat exchanger, to which the bracket is provided, and fitted to an outer side of the load supporting section, an inner surface of the fitting member located above the load support section directly contacting a majority of an outer surface of the load supporting section, the outer surface of the load supporting section extending into the fitting member; and a contact section provided to the other heat exchanger, to be in contact with at least a part of the bracket by pressing the bracket from an upper side, wherein the fitting member is supported between the load supporting section and the contact section in a state where the fitting member is fitted to the outer side of the load supporting section.

2. The heat exchanger mounting structure according to claim 1, wherein the contact section is placed to the fitting member at a position right above the load supporting section.

3. The heat exchanger mounting structure according to claim 1, wherein the contact section has a contact surface in contact with an upper surface of the bracket, and the contact surface has a sloped part which is sloped upward as going toward a tip end of the contact surface.

4. The heat exchanger mounting structure according to claim 1, wherein the contact section has a contact surface in contact with an upper surface of the bracket, and a rib extending in a direction intersecting with the contact surface.

5. The heat exchanger mounting structure according to claim 1, wherein the bracket has a pressed part which is pressed by the contact section from the upper side, the pressed part being projected from a side surface of the bracket at a position lower than an upper end of the bracket.

6. The heat exchanger mounting structure according to claim 1, wherein the load supporting section has a square-pillar-shaped protrusion part.

7. The heat exchanger mounting structure according to claim 6, wherein the bracket has a fitting hole passing through the engaging portion, the engaging projection part has two nail projections spaced from each other by a predetermined interval, and the fitting hole has an inner periphery surface defining the engaging portion, and the inner periphery surface is engaged with the two nail projections of the engaging projection part.

8. The heat exchanger mounting structure according to claim 6, wherein the fitting member is a rectangular pipe component surrounding all side surfaces of the square-pillar-shaped protrusion part of the load supporting section, the contact section is a flat-plate component with a predetermined interval from an upper surface of the load supporting section, and covers at least the upper surface of the load supporting section, and the contact section has a pressing part pressing the bracket from the upper side in a state where the fitting member is supported between the load supporting section and the contact section.

9. The heat exchanger mounting structure according to claim 8, wherein the fitting member has a top fitting part fitted on an outer side of the upper surface of the load supporting section, a lower fitting part fitted on an outer side of a lower surface of the load supporting section, a left side fitting part fitted on an outer side of a left side surface of the load supporting section and a right side fitting part fitted on an outer side of a right side surface of the load supporting section, and a lower surface of the top fitting part is in contact with the upper surface of the load supporting section, and an upper surface of the top fitting part is in contact with a lower surface of the contact section, such that the top fitting part is supported between the contact section and the load supporting section.

10. The heat exchanger mounting structure according to claim 1, wherein a clearance is defined between the fitting member and the contact section such that the fitting member is able to incline relative to the contact section in the state where the fitting member is supported between the load supporting section and the contact section.

11. The heat exchanger mounting structure according to claim 1, wherein the fitting member and the bracket are located directly adjacent to each other in a direction perpendicular to a direction in which the fitting member opposes the load supporting section and the contact section, and in which the engaging portion opposes the engaging projection part.

12. The heat exchanger mounting structure according to claim 1, wherein the engaging projection part and the load supporting section are located directly adjacent to each other, and the load supporting section and the contact section are located directly adjacent to each other.

13. The heat exchanger mounting structure according to claim 1, wherein the first heat exchanger has an upper portion and the second heat exchanger has an upper portion, and wherein the bracket, the engaging projection part, the engaging portion, the load supporting section, the fitting member and the contact section are located at the upper portion of the first heat exchanger and the upper portion of the second heat exchanger.

* * * * *